US011505387B2

(12) United States Patent
Hogan et al.

(10) Patent No.: US 11,505,387 B2
(45) Date of Patent: Nov. 22, 2022

(54) COVER SHEET

(71) Applicant: MEDI-Clear Ltd, Hull (GB)

(72) Inventors: Mark Paul Hogan, Hull (GB); Steven Brian Watt, Hull (GB)

(73) Assignee: MEDI-Clear Ltd, Hull (GB)

( * ) Notice: Subject to any disclaimer, the term of this patent is extended or adjusted under 35 U.S.C. 154(b) by 0 days.

(21) Appl. No.: 17/234,072

(22) Filed: Apr. 19, 2021

(65) Prior Publication Data

US 2021/0323744 A1 Oct. 21, 2021

(30) Foreign Application Priority Data

Apr. 20, 2020 (GB) ..... 2005706

(51) Int. Cl.
*B65D 77/20* (2006.01)

(52) U.S. Cl.
CPC .... *B65D 77/2056* (2013.01); *B65D 2577/205* (2013.01); *B65D 2577/2091* (2013.01)

(58) Field of Classification Search
CPC .. B65D 2577/2041; B65D 35/44; B65D 7/34; B65D 77/2096; B65D 77/12; B65D 77/2056; B65D 2577/205; B65D 2577/2091; B65D 25/36; B65D 65/40; B65D 77/20; B65D 73/00; B65D 1/34; B65D 77/2048
See application file for complete search history.

(56) References Cited

U.S. PATENT DOCUMENTS 3,286,909 A 11/1966 Scharre
3,394,869 A * 7/1968 Fontana ..... B65D 77/2032 229/120.07
4,116,336 A * 9/1978 Sorensen ..... B01J 13/025 206/524.8
4,449,633 A * 5/1984 Johnson ..... B65D 5/545 229/242
4,896,772 A * 1/1990 Walter ..... B65D 25/04 206/524.2
4,994,638 A * 2/1991 Iorns ..... B65D 81/3216 219/734

(Continued)

OTHER PUBLICATIONS

Combined Search and Examination Report for Great Britain Application No. GB2005706.3, published by the United Kingdom Intellectual Property Office, dated Oct. 8, 2020, 3 pages.

(Continued)

*Primary Examiner* — Kareen K Thomas
(74) *Attorney, Agent, or Firm* — Kilyk & Bowersox, P.L.L.C.

(57) ABSTRACT

A cover sheet to be secured to the tray of a container is described. The cover sheet includes a first layer and a second layer. An adhesive layer is provided between the first and second layers. The first layer has a first cut line that extends across a corner of the cover sheet between a first edge and a second edge to define a tab portion of the first layer. The second layer has a second cut line that extends from the first edge to the second edge or a third edge to define a removable strip of the second layer. Removing the removable strip and the adhered tab portion exposes the adhesive layer on a securing portion of the first layer that can be used to secure the cover sheet to the tray.

11 Claims, 6 Drawing Sheets

(56) References Cited

U.S. PATENT DOCUMENTS

| | | | | | |
|---|---|---|---|---|---|
| 5,012,929 | A * | 5/1991 | Roosa | B65D 5/542 | 229/120.08 |
| 5,042,652 | A * | 8/1991 | Grindrod | B65D 75/02 | 206/557 |
| 5,393,032 | A * | 2/1995 | Cederroth | B65D 77/2052 | 206/532 |
| 5,423,449 | A * | 6/1995 | Gordon | B65D 77/04 | 220/62.2 |
| 5,588,587 | A * | 12/1996 | Stier | B65D 81/343 | 229/207 |
| 5,695,798 | A * | 12/1997 | Rozzano | B65D 1/36 | 426/115 |
| 5,735,406 | A * | 4/1998 | Keffeler | B65D 83/0445 | 206/538 |
| 5,843,501 | A * | 12/1998 | Rubin | B32B 7/12 | 206/524.1 |
| 6,086,931 | A * | 7/2000 | Whiteford | B65D 85/324 | 426/106 |
| 7,093,816 | B2 * | 8/2006 | Lacan | F25C 1/243 | 426/106 |
| 9,027,825 | B2 * | 5/2015 | Baker | B65D 25/00 | 206/524.1 |
| 10,501,248 | B2 * | 12/2019 | Ghiam | B65B 3/022 | |

OTHER PUBLICATIONS

Search Report under Section 17 for Great Britain Application No. GB2005706.3, published by the United Kingdom Intellectual Property Office, dated Oct. 6, 2020, 1 page.

* cited by examiner

COVER SHEET

FIELD OF THE INVENTION

The invention relates to cover sheets, and in particular to cover sheets that are secured to the tray of a container for storing and dispensing consumer products.

The term consumer products is intended to cover a wide variety of products as illustrated by the following (non-exhaustive) list: foods, either for immediate consumption, pre-cooked, prepared or oven ready, including prepared meals, confectionary, hardware and DIY items, cosmetics, seeds, animal and fish feeds, electronic components, medical appliances and dressings, medicines and medication such as pills, tablets and capsules. The container may be used in place of conventional blister packs for the packaging of pills, tablets and capsules, or may be used for organising and storing mixed medication for subsequent dispensation according to a predefined dosage regimen. The principle behind such mixed medication containers is that a dosage regimen of mixed medication can be organised in advance for a period of a week or more, and a patient or nurse can then remove from the container, at predefined times over the said period, the one or more pills, tablets and/or capsules to be administered on each occasion according to the dosage regimen.

BACKGROUND ART

A container for storing and dispensing consumer products typically includes a tray having a generally planar top surface into which has been formed an array of discrete cavities for receiving the consumer products. The cavities are covered by a seal which is secured to the generally planar top surface of the tray.

The seal can have one or more layers. Each seal layer can be a metal foil, such as aluminium foil, a metallized polymeric film or paper sheet, a plastics film of single or multiple layer construction, or any combination thereof, depending on the sort of consumer products to be stored and dispensed from the container. Each seal layer can be a translucent or transparent, flexible sheet of plastics material such as polypropylene or polyethylene terephthalate, for example.

SUMMARY OF THE INVENTION

The present invention provides a cover sheet to be secured to the tray of a container in use, the cover sheet comprising a first edge, a second edge, and a third edge that is opposite the first edge, the cover sheet further comprising:

a. a first layer having an upper surface that defines an upper surface of the cover sheet and a lower surface on which an adhesive layer is applied; and b. a second layer having a lower surface that defines a lower surface of the cover sheet and an upper surface on which a release layer is applied, wherein the release layer is in contact with the adhesive layer;

c. the first layer having a first pre-formed line of separation that extends across a corner of the cover sheet between the first edge and the second edge to define a tab portion of the first layer, wherein a first intermediate point lying along the first pre-formed line of separation divides the first pre-formed line of separation into a first part that extends from the first intermediate point to the first edge, and a second part that extends from the first intermediate point to the second edge;

d. the second layer having a second pre-formed line of separation that extends from the first edge to one of the second edge and the third edge to define a removable strip of the second layer that is adapted to be removed from the adhesive layer to expose the adhesive layer on a securing portion of the first layer for securing the cover sheet to the tray, wherein a second intermediate point lying along the second pre-formed line of separation, and substantially coincident with the first intermediate point, divides the second pre-formed line of separation into a first part that extends from the second intermediate point to the first edge substantially coincident with the first part of the first pre-formed line of separation, and a second part that extends from the second intermediate point towards the third edge substantially parallel with the second edge.

The first layer can be a face layer and the second layer can be a liner or backing layer.

The first and second layers of the cover sheet can be formed of any suitable material. A suitable material is paper or card.

The upper surface of the first layer can provide a printable upper surface of the cover sheet.

The release layer is applied to the upper surface of the second layer (i.e., the surface that faces the lower surface of the first layer) to allow the removable strip of the second layer to be removed easily and cleanly from the adhesive layer. Any suitable release layer or coating can be used, e.g., a commercially-available silicone-based release layer.

The tab portion of the first layer remains adhered to the removable strip and is removed with it. Once the removable strip is removed from the remainder of the first layer by being peeled away from the adhesive layer, the exposed adhesive on the lower surface of the first layer allows the cover sheet to be secured to the tray. The lower surface of the second layer defines a lower surface of the cover sheet. The cover sheet that is secured to the tray includes all of the first layer except the tab portion and all of the second layer except the removable strip.

The tray has a generally planar top surface into which has been formed an array of discrete cavities for receiving the consumer products. The cover sheet is typically secured to the underside of an overhanging part of the top surface of the tray with the cover sheet upside down—i.e., if the tray is positioned with the mouths of the cavities facing upwards, the upper surface of the cover sheet will initially be facing downwards to present the exposed adhesive layer to the underside of the overhanding part of the top surface. The cover sheet can then be folded over along the overhanging part of the tray so that its printable upper surface is facing upwards and it overlies the top surface of the tray and the seal.

The first and second parts of the first pre-formed line of separation can have any suitable shape (e.g., straight, curved, wavy, zig-zag etc.) and can be aligned or angled with respect to each other. The first and second parts of the second pre-formed line of separation can have any suitable shape (e.g., straight, curved, wavy, zig-zag etc.) and are normally angled with respect to each other.

In a preferred arrangement of the first pre-formed line of separation, the first part is curved and the second part is straight and extends substantially perpendicular to the second edge. But it will be readily understood that other arrangements are possible—see above.

In a preferred arrangement of the second pre-formed line of separation, the first part is curved (and substantially coincident with the first part of the first pre-formed line of separation) and the second part is straight and extends substantially parallel with the second edge. But it will be readily understood that other arrangements are possible—see above. The second part can extend to the third edge or the second pre-formed line of separation can include a third part which extends to the second edge—e.g., where the third part is straight and extends substantially perpendicular to the second edge, or is curved, wavy or zig-zag.

The first and second pre-formed lines of separation can be cut lines, or pre-formed tear lines (e.g., score lines or perforated lines), or any combination thereof, and can be formed using a die cutter, for example. Cut lines extend all of the way through the respective layer. Score lines extend only part of the way through the respective layer. Perforated lines comprise a series of cuts and ties.

If the first pre-formed line of separation is a pre-formed tear line (e.g., a score line or perforated line) it will be torn when the tab portion of the first layer is removed together with the removable strip. In particular, the first pre-formed line of separation will tear to release the tab portion from the remainder of the first layer. If the second pre-formed line of separation is a pre-formed tear line (e.g., a score line or perforated line) it will be torn when the removable strip is removed. In particular, the second pre-formed line of separation will tear to release the removable strip from the remainder of the second layer.

At least the first part of the first pre-formed line of separation can be a cut line and at least the first part of the second pre-formed line of separation can be a cut line.

The first part of the first line of separation can include a gap that defines a first frangible bridge region (or tie). The first frangible bridge region temporarily connects the tab portion of the first layer to the remainder of the first layer and can be broken or torn preparatory to removing the removable strip. This releases the tab portion which can be grasped between thumb and forefinger, together with the underlying portion of the second layer that defines a tab portion of the removable strip, and used to peel away the removable strip to expose the adhesive layer. The first frangible bridge region can be positioned anywhere along the first part of the first pre-formed line of separation, but is preferably adjacent the first edge. In practice, this can mean that the first pre-formed line of separation does not extend completely to the first edge of the cover sheet, but is separated from the first edge by the first frangible bridge region.

Additionally, or alternatively, the first part of the second pre-formed line of separation can include a gap that defines a second frangible bridge region (or tie). The second frangible bridge region temporarily connects the removable strip of the second layer—and in particular the tab portion of the removable strip—to the remainder of the second layer and can be broken or torn preparatory to removing the removable strip. The second frangible bridge region can be positioned anywhere along the first part of the second pre-formed line of separation, but is preferably adjacent the first edge. In practice, this can mean that the second pre-formed line of separation does not extend completely to the first edge of the cover sheet, but is separated from the first edge by the second frangible bridge region.

Alternatively, the first part of the second pre-formed line of separation can be non-coincident with the first part of the first pre-formed line of separation (and the first and second intermediate points can also be non-coincident) such that the tab portion of the removable strip is larger than the tab portion of the first layer. The tab portion of the removable strip is removably adhered to a narrow strip of the first layer that extends adjacent to the first part of the first pre-formed line of separation to hold the tab portion of the first layer in position within the plane of the remainder of the cover sheet. The tab portion of the removable strip can be released from the narrow strip of the first layer by peeling it away from the adhesive layer. This releases the tab portion of the first layer which can be grasped between thumb and forefinger, together with the underlying portion of the second layer that defines the tab portion of the removable strip, and used to remove the removable strip completely to expose the adhesive layer. Alternatively, the tab portion of the first layer is larger than the tab portion of the removable strip. The term "substantially coincident" used herein should therefore be understood to cover this particular cover sheet arrangement, i.e., where the first parts of the first and second pre-formed lines of separation (and the first and second intermediate points) are deliberately spaced slightly apart, as well as referring to a more general tolerance in the exact alignment between the first parts of the first and second pre-formed lines of separation and the first and second intermediate points; it being readily understood that a small misalignment will not have any significant effect on the cover sheet.

Any suitable adhesive can be used for the adhesive layer, e.g., a peelable adhesive.

The present invention further provides a method of securing the cover sheet described above to the tray of a container, the tray comprising a generally planar top surface and one or more discrete cavities for receiving consumer products, the method comprising the steps of:

a. removing the removable strip to expose the adhesive layer on a securing portion of the first layer; and
b. securing the securing portion to the tray using the exposed adhesive layer.

For example, a securing part of the cover sheet is secured to the underside of an overhanging part of the top surface of the tray by the exposed adhesive layer.

The present invention further provides a container for storing and dispensing consumer products comprising:

a. a tray comprising a generally planar top surface and one or more discrete cavities for receiving consumer products; and
b. a cover sheet described above secured to the tray, e.g., where a securing part of the cover sheet is secured to the underside of an overhanging part of the top surface of the tray.

The container can further include a seal secured to the top surface of the tray and the cover sheet can overlie the seal.

The container can be a multiple-compartment container for containing and dispensing medication according to a pre-defined dosage regimen.

Figure 1:
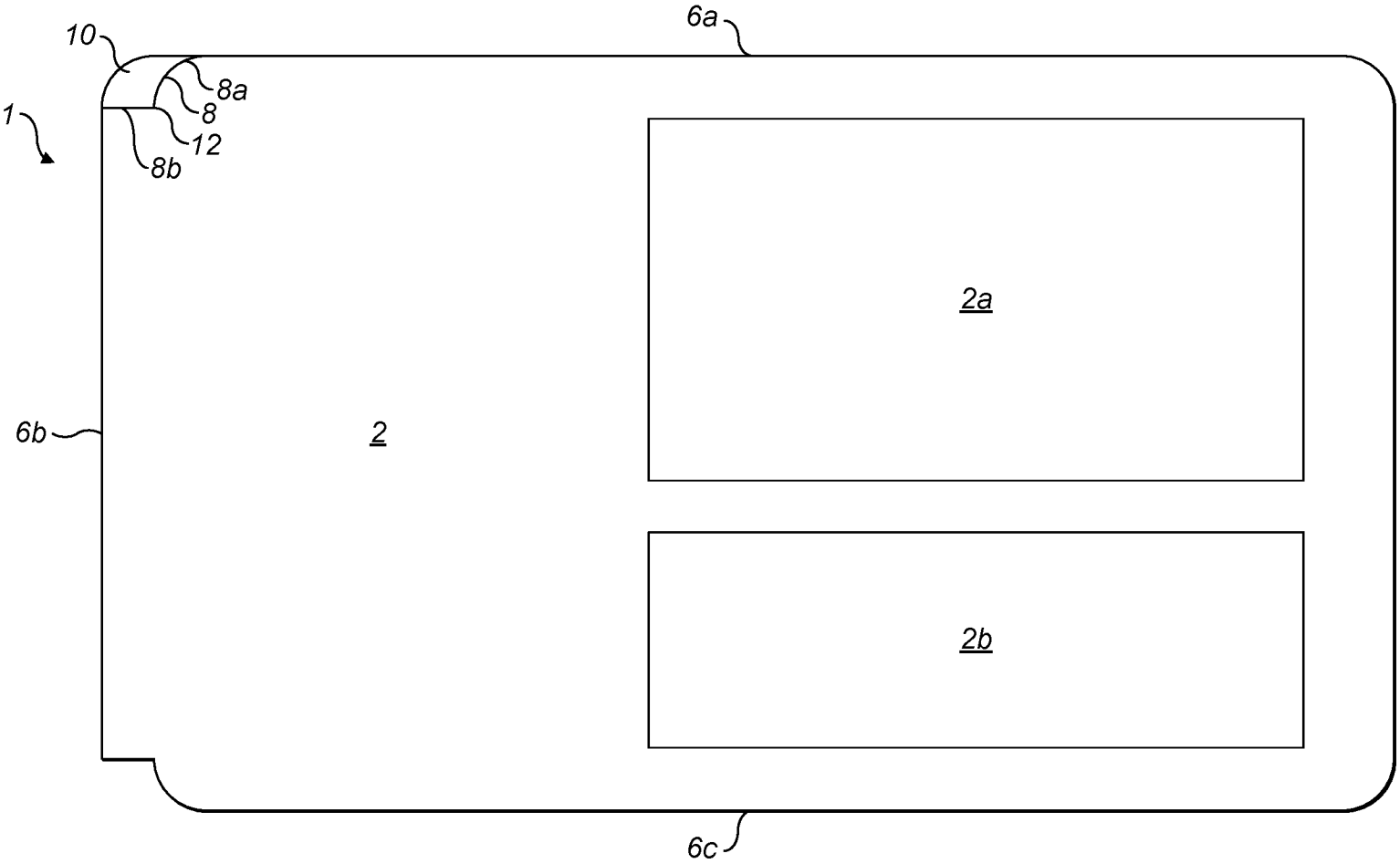
FIG. 1 is a top view of a cover sheet according to the present invention showing a first layer.

A cover sheet 1 is shown in FIGS. 1 to 7 and is adapted to be secured to the tray of a container for dispensing medication.

The cover sheet 1 includes a first layer 2 (e.g., a face layer) and a second layer 4 (e.g., a liner or backing layer). The cover sheet 1 is substantially rectangular and includes a first edge 6*a*, a second edge 6*b*, a third edge 6*c* and a fourth edge 6*d*. But it will be readily understood that the cover sheet can have any suitable shape.

The first layer 2 can be made of paper or card. The upper surface of the first layer 2 is a printable surface and defines the upper surface of the cover sheet 1. The upper surface includes areas 2*a*, 2*b* where information can be printed, e.g., information relating to the medication that is stored in the container or the like. An adhesive layer (not shown) is applied to the lower surface of the first layer 2 and adheres the first and second layers together.

The second layer 4 can also be made of paper or card. The lower surface of the second layer 4 defines the lower surface of the cover sheet 1. A release layer or coating (not shown) is applied to the upper surface of the second layer 4. The release layer is in contact with the adhesive layer and allows the second layer 4 to be removed easily and cleanly from the adhesive layer.

The first layer 2 includes a first cut line 8 that extends across a corner of the cover sheet 1 between the first edge 6*a* and the second edge 6*b* as shown in FIGS. 1, 3, 4 and 5. The first cut line 8 defines a tab portion 10 of the first layer 2.

A first intermediate point 12 lying along the first cut line 8 divides the first cut line into a first part 8*a* that extends from the first intermediate point to the first edge 6*a*, and a second part 8*b* that extends from the first intermediate point to the second edge 6*b*. The first part 8*a* is curved and the second part 8*b* is straight and extends substantially perpendicular to the second edge 6*b*.

Figure 2:
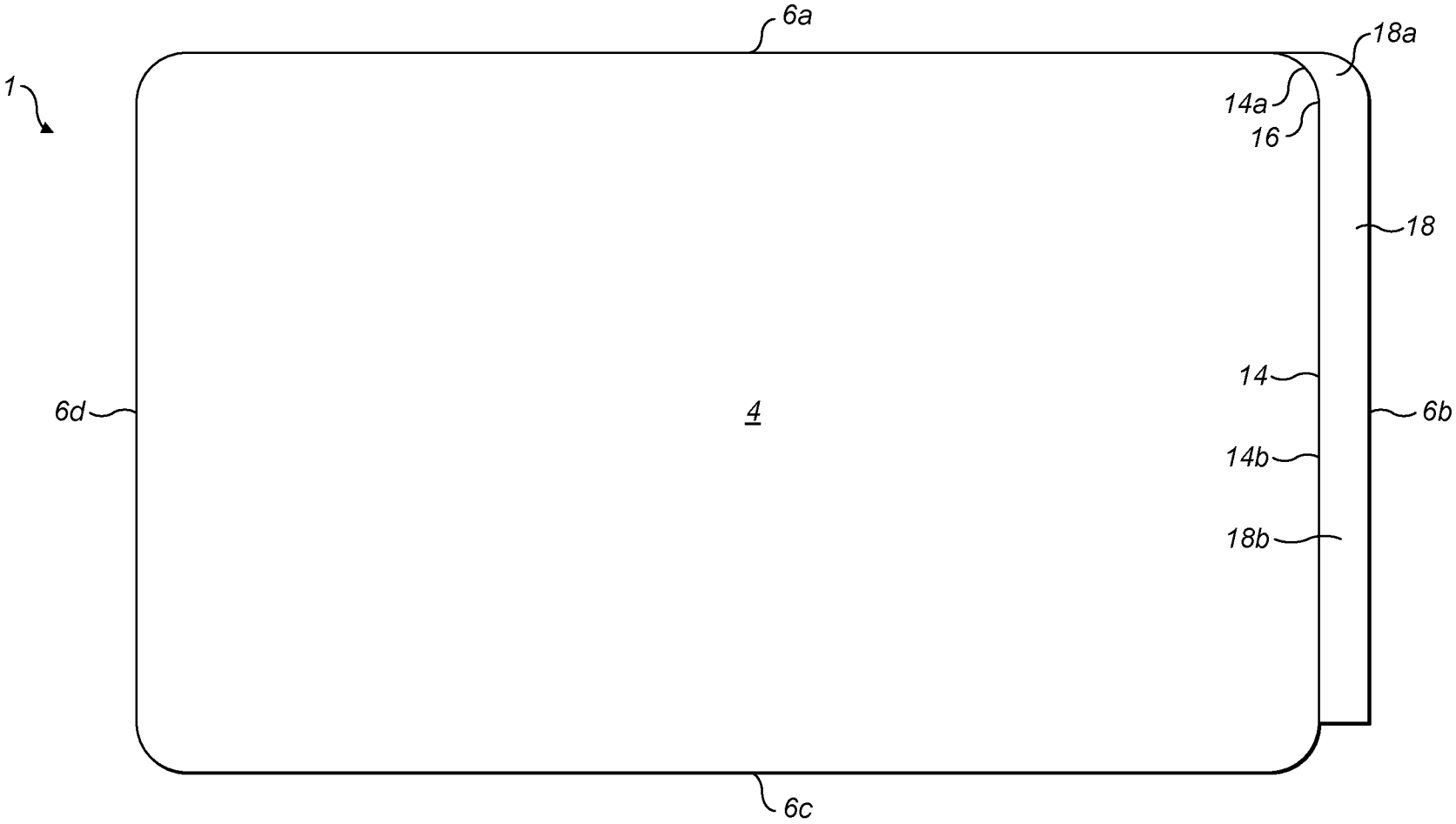
FIG. 2 is a bottom view of the cover sheet of FIG. 1 showing a second layer before a removable strip is removed.
Figure 5:
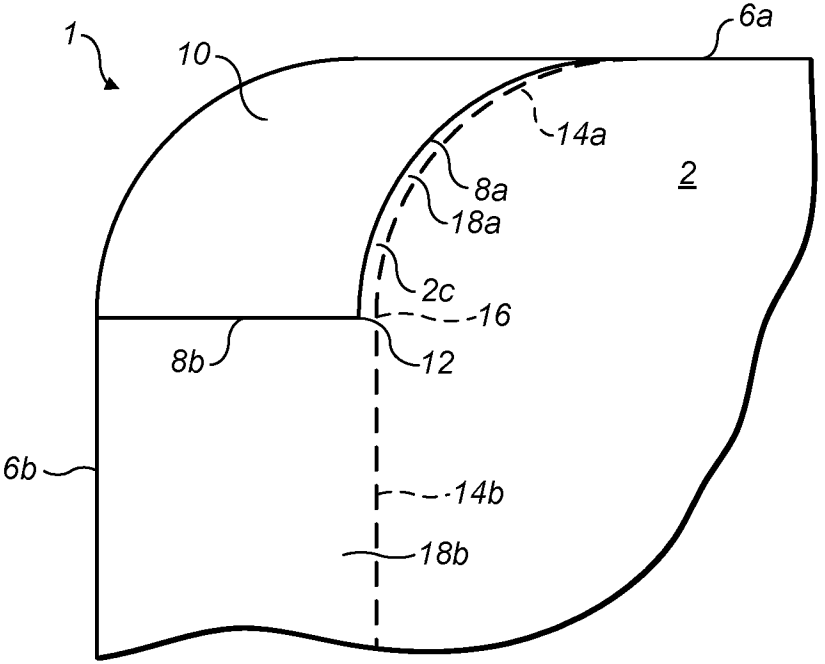
FIG. 5 is a detail view of a third cover sheet arrangement.

The second layer 4 includes a second cut line 14 that extends from the first edge 6*a* to the third edge 6*c* as shown in FIGS. 2 and 5.

It will be readily understood that the first and second cut lines 8, 14 can be replaced with pre-formed tear lines, e.g., score lines or perforated lines, which would tear when the removable strip 18 and the tab portion 10 are removed.

A second intermediate point 16 lying along the second cut line 14 divides the second cut line 14 into a first part 14*a* that extends from the second intermediate point to the first edge 6*a* and a second part 14*b* that extends from the second intermediate point to the third edge 6*c*. The first part 14*a* is curved and the second part 14*b* is straight and extends substantially parallel with the second edge 6*b*.

The second cut line 14 defines a removable strip 18 of the second layer 4. The removable strip 18 can include a tab portion 18*a* at one end that underlies and is adhered to the tab portion 10 of the first layer 2, and a strip portion 18*b* that extends along the second edge 6*b* of the cover sheet 1 and that underlies and is adhered to a securing portion of the first layer which is shown most clearly in FIG. 6.

Figure 4:
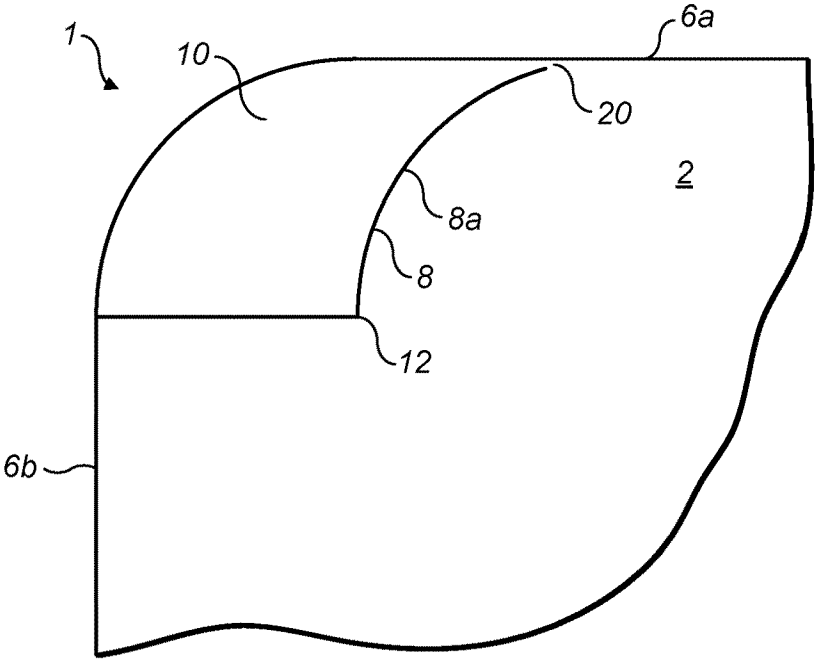
FIG. 4 is a detail view of a second cover sheet arrangement.
Figure 3:
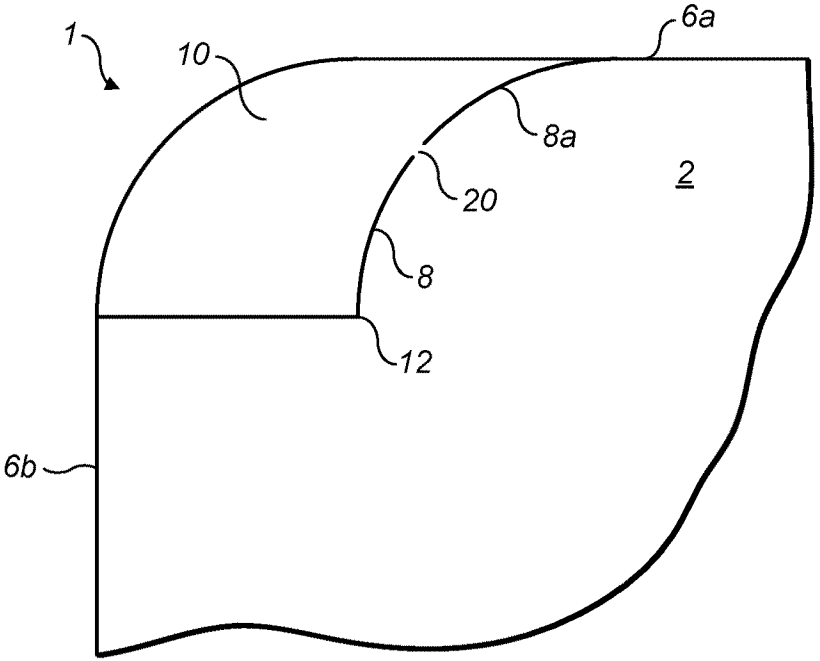
FIG. 3 is a detail view of a first cover sheet arrangement.

In the cover sheet arrangements shown in FIGS. 3 and 4, the first and second intermediate points 12, 16 are coincident (or aligned) with each other. The first parts 8*a*, 14*a* of the first and second cut lines 8, 14 are also coincident (or aligned) with each other. The tab portions 10, 18*a* of the first layer 2 and the removable strip 18 are the same size and would be free to bend out of the plane of the remainder of the cover sheet 1. To keep the tab portions 10, 18*a* in position, and in particular so that they remain in the plane of the remainder of the cover sheet, the first part 8*a* of the first cut line 8 can include a gap that defines a frangible bridge region 20. FIG. 3 shows a frangible bridge region 20 that is positioned at a midpoint along the first part 8*a* of the first cut line 8. FIG. 4 shows a frangible bridge region 20 that is positioned at the end of the first part 8*a* of the first cut line 8 adjacent the first edge 6*a*. In practice, this means that the first cut line 8 does not extend completely to the first edge 6*a* of the cover sheet, but is separated from the first edge by the frangible bridge region 20. The frangible bridge region 20 temporarily connects the tab portion 10 to the remainder of the first layer 2 and can be broken or torn preparatory to removing the removable strip 18. A similar frangible bridge region (not shown) can be provided in the first part 14*a* of the second cut line 14 to temporarily connect the underlying tab portion 18*a* of the second layer to the remainder of the second layer 4 and which can be broken or torn preparatory to removing the strip portion 18*a* of the removable strip 18.

The tab portion 10 and the underlying tab portion 18*a* of the removable strip 18 can be grasped between thumb and forefinger, bent out of the plane of the remainder of the cover sheet 1 to break or tear the frangible bridge region 20, and then used to peel the strip portion 18*a* of the removable strip 18 away from the adhesive layer. Removing the removable strip 18 exposes the adhesive layer which is on the lower surface of the first layer 2. The tab portion 10 remains adhered to the removable strip 18 and is removed and discarded with it.

FIG. 5 shows an alternative arrangement of the cover sheet 1 where the first parts 8*a*, 14*a* of the first and second cut lines 8, 14 are non-coincident with each other. In other words, the first parts 8*a*, 14*a* are spaced slightly apart. In FIG. 5, the second cut line 14 is shown in dashed lines to indicate that it would not normally be visible in a top view of the cover sheet 1. The first and second intermediate points 12, 16 are also non-coincident with each other and are spaced slightly apart. The tab portion 18*a* of the removable strip 18 is larger than the tab portion 10 of the first layer 2. This means that the tab portion 18*a* is adhered to a narrow strip 2*c* of the first layer 2 that extends adjacent to the first part 8*a* of the first cut line 8. This adhesion between the tab portion 18*a* and the first layer 2 holds the tab portions in position within the plane of the remainder of the cover sheet 1. The tab portion 18*a* can be peeled away from the adhesive layer on the lower surface of the narrow strip 2*c* of the first layer 2. This in turn releases the tab portion 10 which can be grasped between thumb and forefinger, together with the underlying portion of the second layer 4 that defines the tab portion 18*a* of the removable strip 18, and used to remove the removable strip completely to expose the adhesive layer on the securing portion of the first layer 2.

Figure 6:
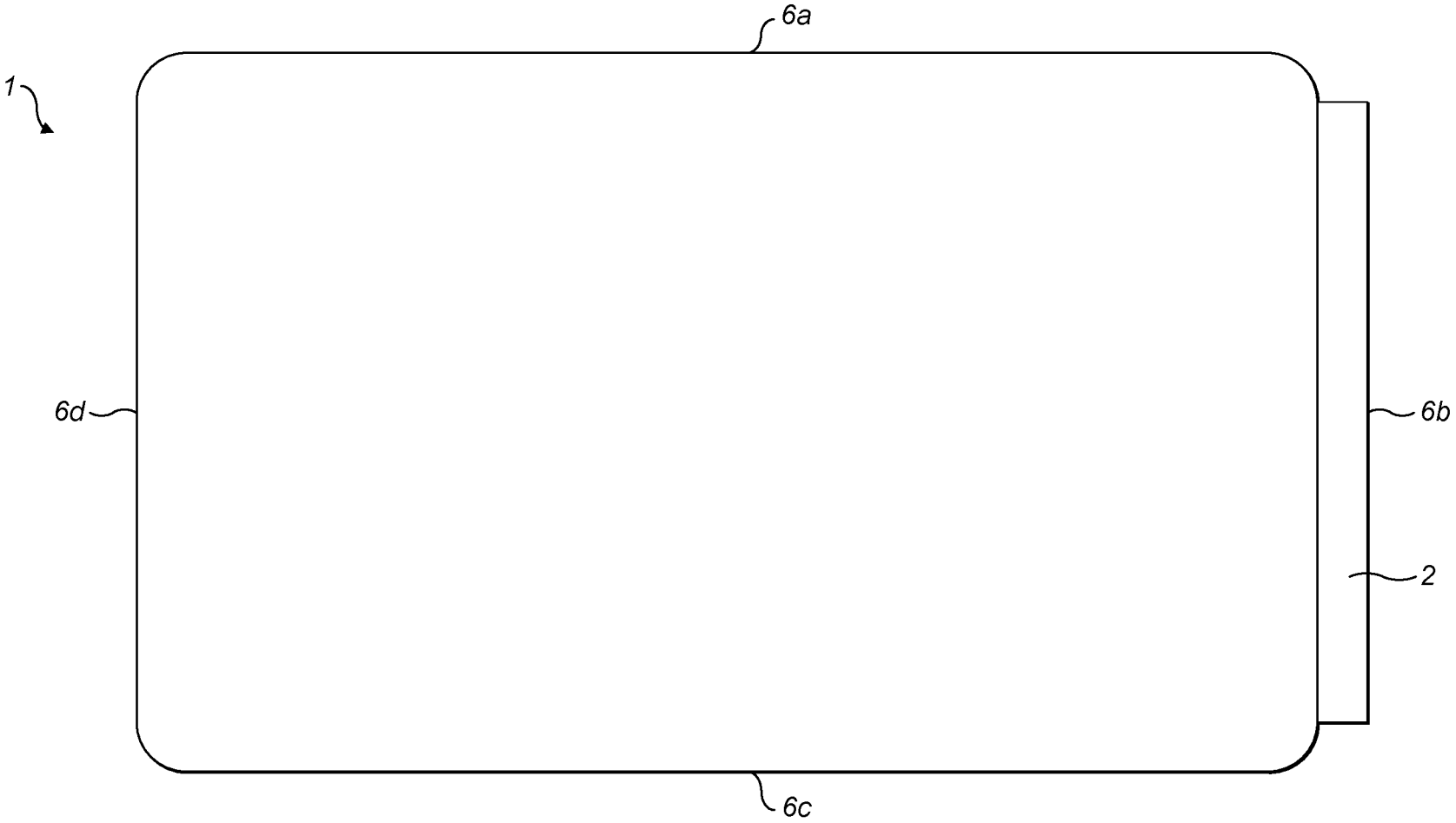
FIG. 6 is a bottom view of the cover sheet of FIG. 1 showing a second layer after a removable strip is removed.

FIG. 6 shows the cover sheet 1 after the removable strip 18 has been removed. The exposed part of the first layer 2 is the securing portion which is used to secure the cover sheet 1 to the tray of a container.

Figure 7:
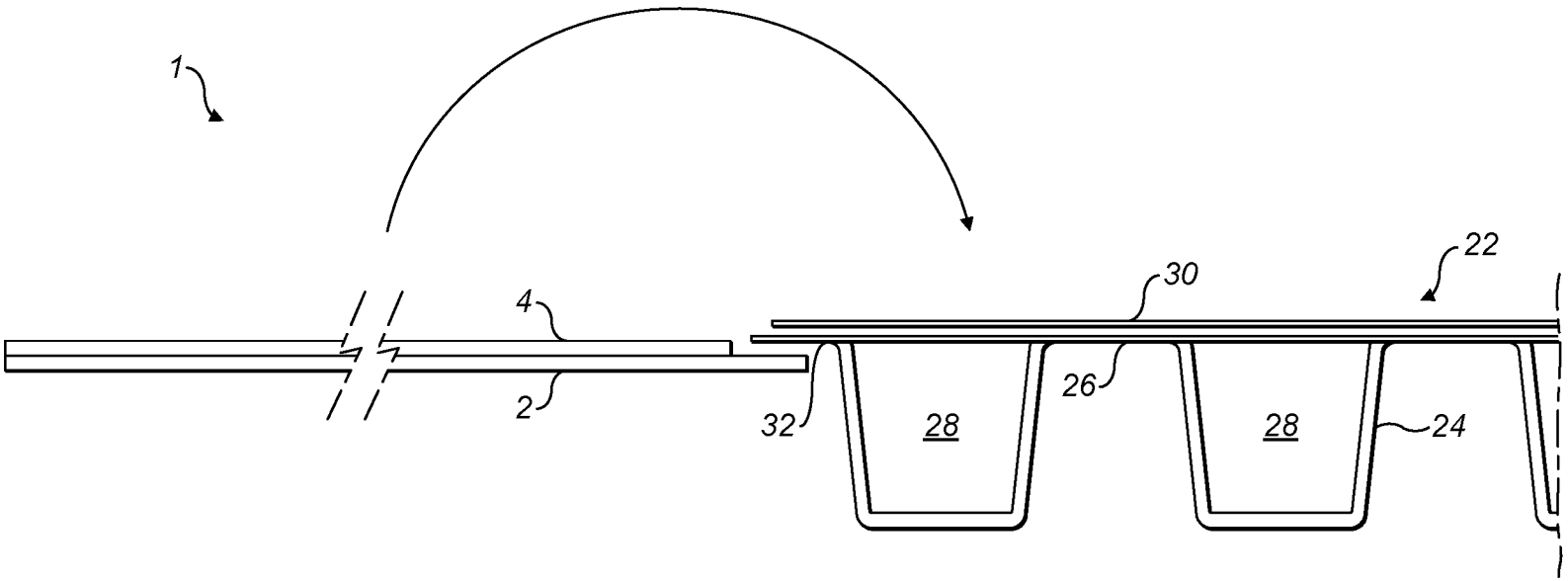
FIG. 7 is a side view showing how the cover sheet according to present invention is secured to the tray of a container.

FIG. 7 shows how the cover sheet 1 can be secured to the tray 24 of a container 22 for dispensing medication. The tray 24 has a generally planar top surface 26 into which has been formed an array of discrete cavities 28 for receiving the medication. A seal 30 is secured to the top surface 26 to cover the open mouths of the cavities 28.

The cover sheet 1 is secured to the underside of an overhanging part 32 of the top surface of the tray 24 with the cover sheet upside down as shown in FIG. 7—i.e., the tray is positioned with the mouths of the cavities facing upwards and the upper surface of the cover sheet 1 defined by the upper surface of the first layer 2 is facing downwards. Once the securing part of the cover sheet 1 has been secured to the underside of the overhanging part 32 by the exposed adhesive layer, the cover sheet 1 can be folded over along the edge of the overhanging part as indicated by the arrow so that its upper surface is facing upwards and it overlies the top surface of the tray 24 and the seal 30.

The invention claimed is:

1. A cover sheet to be secured to a tray of a container in use, the cover sheet comprising a first edge, a second edge, and a third edge that is opposite the first edge, the cover sheet further comprising:

(a) a first layer having an upper surface that defines an upper surface of the cover sheet and a lower surface on which an adhesive layer is applied; and (b) a second layer having a lower surface that defines a lower surface of the cover sheet and an upper surface on which a release layer is applied, wherein the release layer is in contact with the adhesive layer;

(c) the first layer having a first pre-formed line of separation that extends across a corner of the cover sheet between the first edge and the second edge to define a tab portion of the first layer, wherein a first intermediate point lying along the first pre-formed line of separation divides the first pre-formed line of separation into a first part that extends from the first intermediate point to the first edge, and a second part that extends from the first intermediate point to the second edge;

(d) the second layer having a second pre-formed line of separation that extends from the first edge to one of the second edge and the third edge to define a removable strip of the second layer that is adapted to be removed from the adhesive layer to expose the adhesive layer on a securing portion of the first layer for securing the cover sheet to the tray, wherein a second intermediate point lying along the second pre-formed line of separation, and substantially coincident with the first intermediate point, divides the second pre-formed line of separation into a first part that extends from the second intermediate point to the first edge substantially coincident with the first part of the first pre-formed line of separation, and a second part that extends from the second intermediate point towards the third edge substantially parallel with the second edge.

2. The cover sheet of claim 1, wherein the upper surface of the first layer is a printable upper surface.

3. The cover sheet of claim 1, wherein the first part of the first pre-formed line of separation is straight or curved, and the second part of the first pre-formed line of separation is straight and extends substantially perpendicular to the second edge.

4. The cover sheet of claim 3, wherein the first part of the second pre-formed line of separation is straight or curved, and coincident with the first part of the first pre-formed line of separation, and the second part of the second pre-formed line of separation is straight and extends substantially parallel with the second edge.

5. The cover sheet of claim 1, wherein the first and second pre-formed lines of separation are cut lines, or pre-formed tear lines, or any combination thereof.

6. The cover sheet of claim 1, wherein at least the first part of the first pre-formed line of separation is a cut line and at least the first part of the second pre-formed line of separation is a cut line.

7. The cover sheet of claim 6, wherein the first part of the first pre-formed line of separation includes a gap that defines a first frangible bridge region that temporarily connects the tab portion of the first layer to the remainder of the first layer.

8. The cover sheet of claim 7, wherein the first frangible bridge region is adjacent the first edge.

9. The cover sheet of claim 6, wherein the first part of the second pre-formed line of separation includes a gap that defines a second frangible bridge region that temporarily connects the removable strip of the second layer to the remainder of the second layer.

10. The cover sheet of claim 9, wherein the second frangible bridge region is adjacent the first edge.

11. The cover sheet of claim 6, wherein the first part of the second pre-formed line of separation is non-coincident with the first part of the first pre-formed line of separation, and wherein a tab portion of the removable strip is larger than the tab portion of the first layer such that the tab portion of the removable strip is removably adhered to a strip of the first layer that extends adjacent to the first part of the first pre-formed line of separation.

* * * * *